US006810807B2

(12) United States Patent
Hebert

(10) Patent No.: US 6,810,807 B2
(45) Date of Patent: Nov. 2, 2004

(54) METHOD AND APPARATUS FOR CLEANING COATING MATERIALS FROM A SUBSTRATE

(75) Inventor: Thomas K. Hebert, Groveland, MA (US)

(73) Assignee: Agfa Corporation, Wilmington, MA (US)

( * ) Notice: Subject to any disclaimer, the term of this patent is extended or adjusted under 35 U.S.C. 154(b) by 65 days.

(21) Appl. No.: 10/095,335

(22) Filed: Mar. 11, 2002

(65) Prior Publication Data

US 2002/0124754 A1 Sep. 12, 2002

Related U.S. Application Data

(60) Provisional application No. 60/275,093, filed on Mar. 12, 2001.

(51) Int. Cl.[7] ..... B41F 35/00

(52) U.S. Cl. ..... 101/424; 101/425

(58) Field of Search ..... 101/483, 424.1, 101/478, 423–425, 465, 466, 468; 15/256.51, 256.52, 256.53; 347/28–30

(56) References Cited

U.S. PATENT DOCUMENTS

| | | | | | |
|---|---|---|---|---|---|
| 5,148,746 | A | | 9/1992 | Fuller et al. | 101/142 |
| 5,574,485 | A | * | 11/1996 | Anderson et al. | 347/27 |
| 5,644,986 | A | * | 7/1997 | Gydesen | 101/424 |
| 5,713,287 | A | * | 2/1998 | Gelbart | 101/467 |
| 6,280,014 | B1 | * | 8/2001 | Sharma et al. | 347/28 |
| 2002/0023566 | A1 | * | 2/2002 | Nakazawa et al. | 101/463.1 |

FOREIGN PATENT DOCUMENTS

EP 1228871 A 8/2002

* cited by examiner

*Primary Examiner*—Anthony H. Nguyen
(74) *Attorney, Agent, or Firm*—John A. Merecki; J. Grant Houston; Robert A. Sabourin

(57) ABSTRACT

The present invention provides a method and apparatus for cleaning a coating material from a surface of a print substrate mounted on the plate cylinder of a printing press using an ultrasonic acoustic cleaning apparatus. The method comprises: applying a cleaning solution onto a surface of the print substrate, rotating the plate cylinder to displace the print substrate under an ultrasonic acoustic cleaning apparatus to dislodge a coating material from the surface of the print substrate, and removing the dislodged coating material and the cleaning solution from the print substrate using a vacuum system.

6 Claims, 3 Drawing Sheets

METHOD AND APPARATUS FOR CLEANING COATING MATERIALS FROM A SUBSTRATE

This application claims the benefit of U.S. Provisional Application No. 60/275,093, filed on Mar. 12, 2001.

FIELD OF THE INVENTION

The present invention is in the field of imaging systems. More particularly, the present invention provides a method and apparatus for cleaning a coating material from a surface of a print substrate mounted on the plate cylinder of a printing press using an ultrasonic acoustic cleaning apparatus.

BACKGROUND OF THE INVENTION

Lithography is the process of printing from specially prepared surfaces, some areas of which are capable of accepting lithographic ink, whereas other areas, when moistened by an aqueous dampening liquid, will not accept the ink. The image to be printed is provided on a lithographic printing master, such as a printing plate, which is mounted on the plate cylinder of a printing press. The printing master carries an image that is defined by the ink accepting areas of the printing surface. A print is obtained by applying ink and a dampening liquid to the printing surface and then transferring the ink from the ink accepting areas of the printing master, using a blanket cylinder, onto a substrate, typically formed of paper.

Many techniques have been used to form an image on a printing master. One common technique, often referred to as "computer-to-film," transfers the image to be printed onto a supply of film using an imagesetter. After processing, the film is used as a mask for the imaging of a plate precursor, comprising, for example, a print substrate (e.g., an aluminum substrate) that has been coated with a thin layer of a photosensitive material. The imaged plate precursor is subsequently processed to obtain a printing plate that can be used as a printing master on a printing press.

Another technique, often called "computer-to-plate" or "direct-to-plate," eliminates the need for film by transferring the image to be printed directly onto a plate precursor using a platesetter, an on-press imaging system, etc. The imaged plate precursor is then processed to obtain a printing plate that can be used as a printing master on a printing press. Upon completion of a press run, the printing master is removed from the plate cylinder of the printing press and discarded or recycled. A new printing master is then mounted onto the plate cylinder of the printing press in preparation of the next press run.

Recently, several computer-to-plate "on-press" imaging techniques have been developed that do not require the printing master to be removed from the plate cylinder of the printing plate upon completion of printing. For example, in one technique, a heat-sensitive coating material, capable of forming a lithographic printing form upon imaging and optional processing, is provided directly on the surface of a reusable hydrophilic print substrate mounted on the plate cylinder of the printing press. (Alternately, the coating material may be provided directly on the surface of the plate cylinder itself.) When the press run is complete, the reusable print substrate (or plate cylinder) is cleaned and recoated with the coating material, at which point it is ready for subsequent imaging and printing.

One such computer-to-plate technology, called LiteSpeed™, recently developed by Agfa-Gevaert N.V. of Mortsel, Belgium, uses a polymer-type liquid lithographic coating material, designed to be sprayed or otherwise applied on an anodized aluminum print substrate, to create a lithographic printing form. The lithographic printing form can be imaged using thermal laser technology soon after application, and is then ready for printing. The non-exposed areas are removed from the lithographic printing form during the printing of the first few (e.g., 10) sheets of paper, allowing the press run to begin immediately after imaging without any additional development. At the end of the print run, the print substrate is completely cleaned prior to the next application of LiteSpeed™ and the next concurrent print job. LiteSpeed™ is non-ablative, requires no chemical processing, and each application is equal in performance to a conventional lithographic printing plate, with a run length of approximately 20,000 impressions.

On-press computer-to-plate systems, such as those described above, will require some form of cleaning prior to the reapplication of the coating material on the print substrate. LiteSpeed™, and switchable polymer-type applied coating technologies, often require the removal of all of the applied polymer coating material, inks, and other contaminants prior to reapplication. The print substrate must be clean and dry prior to reapplication. One consequence of contamination is a latent or "ghost image" from the previous print run that may appear in the printed output of the next print run.

Many cleaning techniques have been proposed to clean a surface in a printing press. For example, U.S. Pat. No. 5,713,287 issued to Gelbart on Feb. 3, 1998 and U.S. Pat. No. 5,148,746 issued to Fuller et al. on Sep. 22, 1992, incorporated herein by reference, both describe cleaning devices and methods that use abrasive techniques to disengage materials from a surface. The former uses a cloth blanket type washer. The latter uses a type of brush or pad to dislodge materials, and a fan or other means for removal. The difficulty in these and other types of abrasive methods is the deteriorated surface condition left on the hydrophilic print substrate, and circumferential interruptions in the plate cylinder surface. These methods tend to produce a shorter print run length with less lithographic latitude. Some of the blanket washer types have the added disadvantage of requiring a full axial volume adjacent to the print cylinder.

Another cleaning technique uses a stream of high pressure water to remove coating materials from the print substrate. After application of a cleaning solution, the stream of high pressure water is sprayed onto the print substrate. The water, removed coating material, inks, cleaner, and other contaminants are then removed from the print substrate surface using a vacuum system. The print substrate is then dried prior to the reapplication of the coating material. Great care must be taken when using this method to prevent the water and other substances removed from the print substrate from detrimentally affecting the on-press imaging system and other components/functions of the printing press. Subsequent filtration of large amounts of water having solubolized materials requires specialized equipment. As such, this process is difficult and costly to implement.

Thus, there is a need for a method and apparatus for cleaning coating materials from a print substrate that avoids the above problems of currently available cleaning systems.

SUMMARY OF THE INVENTION

The present invention provides a method and apparatus for cleaning a coating material from a surface of a print substrate mounted on the plate cylinder of a printing press using an ultrasonic acoustic cleaning apparatus.

Generally, the present invention provides a method for cleaning a print substrate mounted on a plate cylinder, comprising:

applying a cleaning solution onto a surface of the print substrate, rotating the plate cylinder to displace the print substrate under an ultrasonic acoustic cleaning apparatus to dislodge a coating material from the surface of the print substrate, and removing the dislodged coating material and the cleaning solution from the print substrate using a vacuum system.

The present invention additionally provides an apparatus for cleaning a print substrate mounted on a rotating plate cylinder, comprising:

a system for applying a cleaning solution onto a surface of the print substrate, an ultrasonic acoustic cleaning apparatus for dislodging a coating material from the surface of the print substrate, and a vacuum system for removing the dislodged coating material and the cleaning solution from the print substrate.

The present invention further provides an apparatus for cleaning a rotating print substrate, comprising:

a system for applying a cleaning solution to the rotating print substrate using an atomizing spray nozzle, an ultrasonic acoustic cleaning apparatus, including an ultrasonic horn and an ultrasonic transducer for driving the horn, for dislodging a coating material from the print substrate using acoustic cavitation, wherein the atomized cleaning solution serves to focus the energy of the ultrasonic horn onto the coating material to produce the acoustic cavitation, and a vacuum system for removing the dislodged coating material and the cleaning solution from the print substrate.

The present invention also provides an apparatus comprising:

a printing press having a plate cylinder, a reusable print substrate, having a coating material on its surface, mounted on the plate cylinder, an imaging system for exposing an image on the coating material, wherein the exposed image is printed by the printing press, and a cleaning system for cleaning the surface of the print substrate after printing and before a reapplication of the coating material, the cleaning system including a system for applying a cleaning solution onto the surface of the print substrate, an ultrasonic acoustic cleaning apparatus for dislodging the coating material from the surface of the print substrate, and a vacuum system for removing the dislodged coating material and the cleaning solution from the print substrate.

BRIEF DESCRIPTION OF THE DRAWINGS

The features of the present invention will best he understood from a detailed description of the invention and embodiments thereof selected for the purpose of illustration and shown in the accompanying drawings in which.

DETAILED DESCRIPTION OF THE INVENTION

Figure 1:
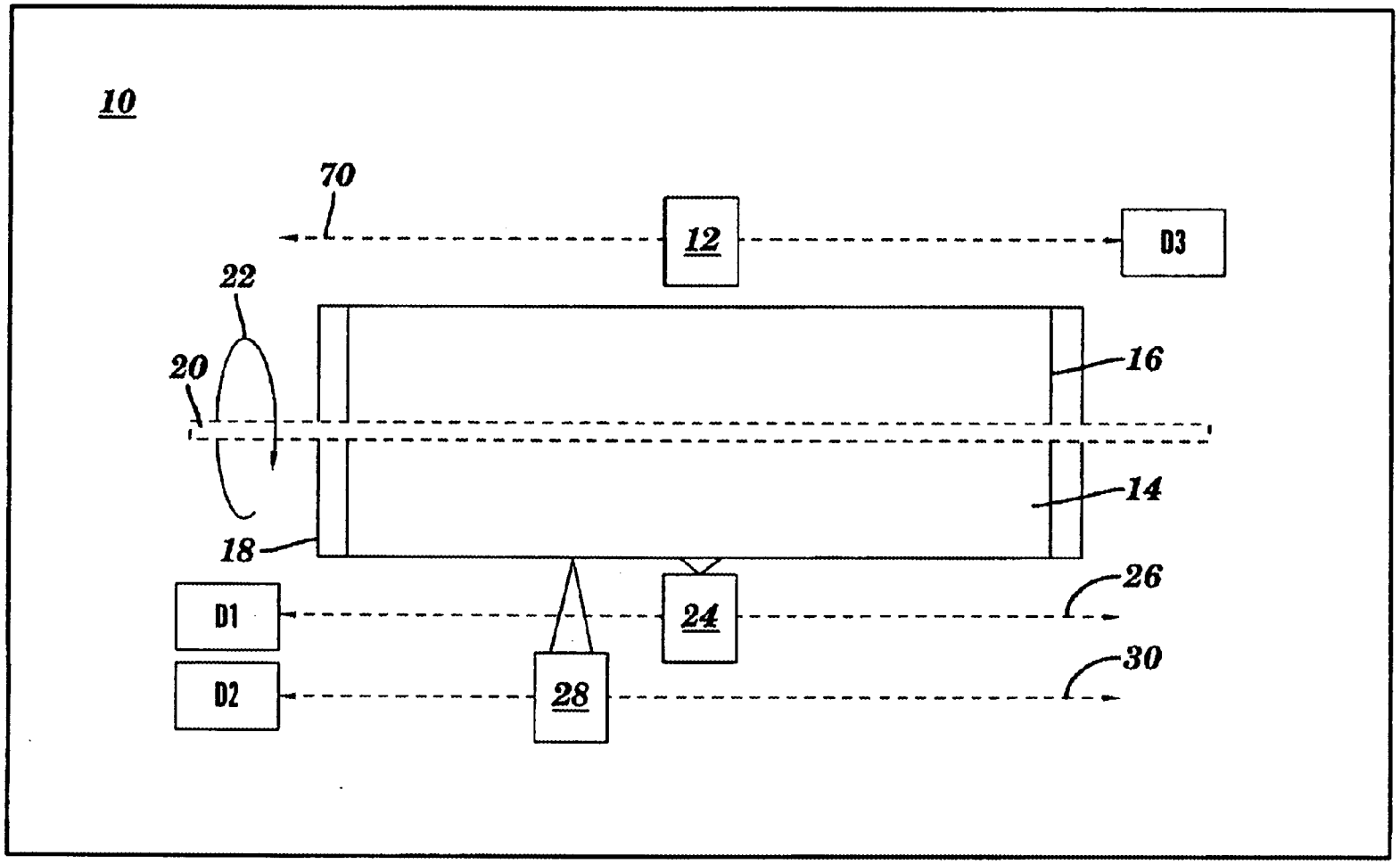
FIG. 1 illustrates a printing press having a plate cylinder and an ultrasonic acoustic cleaning apparatus for cleaning a surface of a print substrate mounted on the plate cylinder, in accordance with an embodiment of the present invention.

The features of the present invention are illustrated in detail in the accompanying drawings, wherein like reference numerals refer to like elements throughout the drawings. Although the drawings are intended to illustrate the present invention, the drawings are not necessarily drawn to scale.

A printing press 10 having an ultrasonic acoustic cleaning apparatus 12 for cleaning a surface 14 of a reusable print substrate 16 in accordance with an embodiment of the present invention is illustrated in FIG. 1. As shown, the reusable print substrate 16 is mounted on a plate cylinder 18 that is configured to rotate about an axis 20 as indicated by directional arrow 22. The printing press 10 is a conventional "on-press" type of printing press in which a coating material, capable of forming a lithographic printing form upon imaging and optional processing (e.g., LiteSpeed™ or switchable polymer-type coatings), is provided directly on the surface 14 of the reusable print substrate 16.

In the example illustrated in FIG. 1, a spraying system 24 is provided to spray the coating material onto the surface 14 of the reusable print substrate 16 prior to imaging and after the cleaning of the surface 14. A drive system D1 displaces the spraying system 24 axially along the plate cylinder 18 as indicated by directional arrow 26 during the application of the coating material. The coating material is applied in a helical pattern on the surface 14 as the spraying system 24 moves axially along the rotating plate cylinder 18. Other techniques for applying the coating material onto the surface 14 of the reusable print substrate 16 are also possible.

An imaging system 28 is provided to form an image on the coating material that has been sprayed on the surface 14 of the reusable print substrate 16 by the spraying system 24. The imaging system 28 can comprise any type of system capable of exposing an image on the coating material. For example, the imaging system may comprise means for generating one or more laser beams and for directing the laser beam(s) onto the coating material to form an image thereon. A drive system D2 is used to displace the imaging system 28 axially along the plate cylinder 18 during imaging (i.e., in a "slow scan" direction) as indicated by directional arrow 30.

Figure 2:
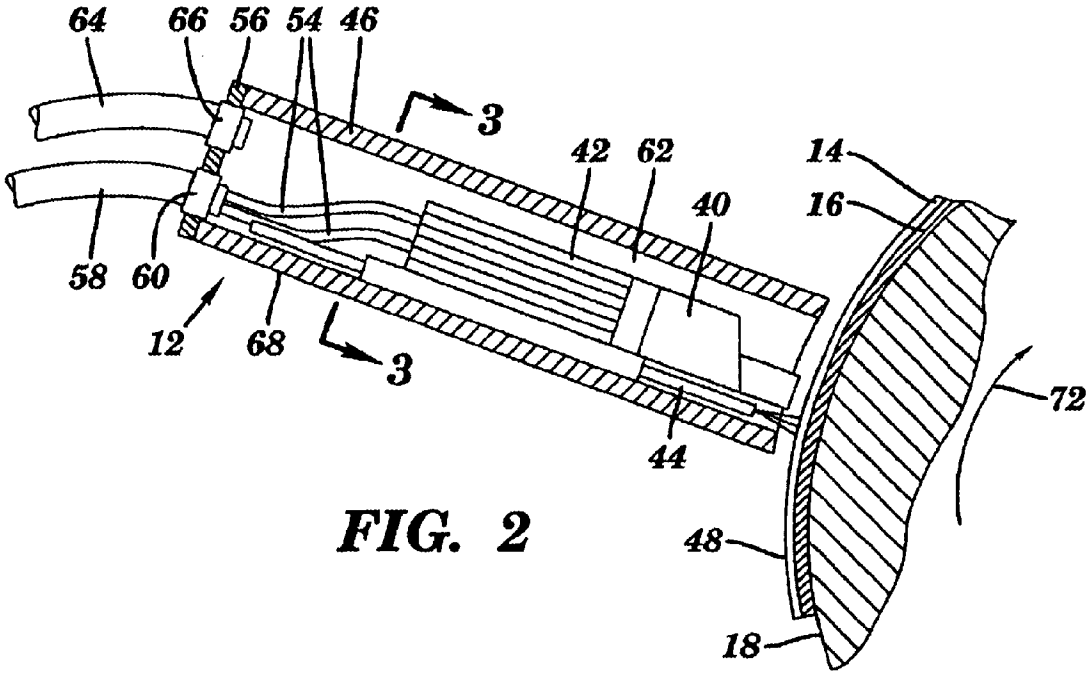
FIG. 2 is a cross-sectional view of a first embodiment of an ultrasonic acoustic cleaning apparatus in accordance with the present invention.
Figure 3:
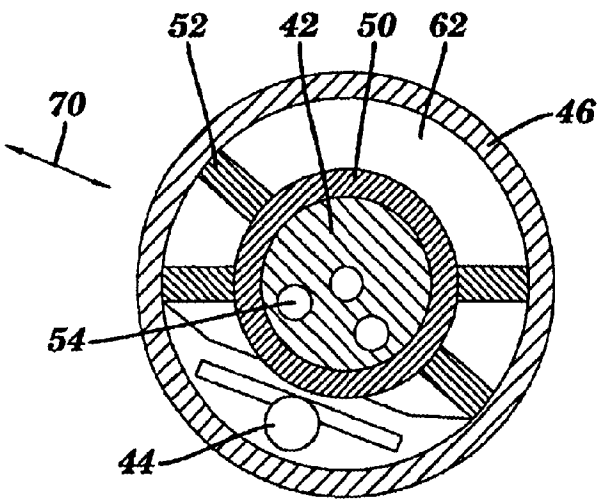
FIG. 3 is a cross-sectional view taken along line 3—3 of FIG. 2.

A cross-sectional view of a first embodiment of the ultrasonic acoustic cleaning apparatus 12 in accordance with the present invention is illustrated in FIG. 2. A cross-sectional view of the ultrasonic acoustic cleaning apparatus 12 taken along line 3—3 of FIG. 2 is illustrated in FIG. 3. The ultrasonic acoustic cleaning apparatus 12 includes an ultrasonic system comprising an ultrasonic horn 40 and an ultrasonic transducer 42 for driving the ultrasonic horn 40. The ultrasonic acoustic cleaning apparatus 12 further includes a spray nozzle 44 for supplying an atomized spray of a cleaning solution. The ultrasonic horn 40, ultrasonic transducer 42, and the spray nozzle 44 are all enclosed within a vacuum cannula 46. As shown in FIG. 2, the ultrasonic acoustic cleaning apparatus 12 is positioned in close proximity to the surface 14 of the print substrate 16. The particular distance of the ultrasonic acoustic cleaning apparatus 12 from the surface 14 of the print substrate 16 is generally application specific, and may be dependent upon many factors, including the power of the ultrasonic transducer 42, the configuration of the ultrasonic horn 40, the type of spray nozzle 44 used, the strength of the vacuum applied within the vacuum cannula 46, the material properties of the coating material 48 to be removed from the surface 14 of the print substrate 16, etc. Similarly, the power of the ultrasonic transducer 42 is generally application specific, and may be dependent upon factors including those presented above. For example, the power of the ultrasonic transducer 42 may be in the range of about 1500 to 6000 watts. Other power values are also possible.

Referring to FIG. 3, the ultrasonic transducer 42 is supported within a housing 50 along a center of the vacuum cannula 46. The housing 50 is attached to an inner surface of the vacuum cannula 46 by a plurality of radially extending ribs 52. Power/control lines 54 of the ultrasonic transducer 42 extend out of the end 56 of the vacuum cannula 46 into a hose 58 through connector 60.

A vacuum is supplied to a vacuum port 62 within the vacuum cannula 46 by a vacuum source (not shown). The vacuum source is coupled to the vacuum port 62 via hose 64 and connector 66.

Cleaning solution is supplied to the spray nozzle 44 through a supply line 68. The supply line 68 extends through connector 60 into hose 58.

In accordance with the present invention, the ultrasonic acoustic cleaning apparatus 12 is used to clean the surface 14 of the print substrate 16 after a print run and before reapplication of the coating material 48. In particular, as shown in FIG. 2, a cleaning solution is directed onto the surface 14 of the print substrate 16 through spray nozzle 44 as the plate cylinder 18 rotates as indicated by directional arrow 72 past the vacuum cannula 46. After passing under the spray nozzle 44, the surface 14 subsequently rotates under the ultrasonic horn 40, which operates to remove the coating material 48 from the surface 14. As rotation of the press-cylinder continues, all debris from the cleaning process is collected and removed through the vacuum port 62. During the cleaning process, the ultrasonic acoustic cleaning apparatus 12 is displaced by a drive system D3 axially along the plate cylinder 18 in a "slow-scan" direction as indicated by directional arrow 70 (see FIGS. 1 and 3). After cleaning, the print substrate 16 may be "refreshed" if necessary using a water rinse.

In previous cleaning systems, a solvent-type cleaning solution was applied on the surface of the print substrate. After waiting some dwell period to allow the solvent to sufficiently soften the bonded polymer of the coating material, the coating material was removed by mechanical means (e.g., scrubbed with a brush or roller). The resultant waste material was then rinsed from the print substrate, and the substrate was dried using hot air. The cleaning solution of the present invention, however, is not only used for its inherent solvent cleaning/softening function, but also as a coupling agent for the ultrasonic horn 40. In particular, when sprayed as a mist between the ultrasonic horn 40 and the print substrate 16, the atomized cleaning solution couples and focuses the energy of the ultrasonic horn 40 to the coating material 48 on the surface 14 of the print substrate 16. The focused energy promotes acoustic cavitation. This cavitation is the result of excitation at the molecular level of the coupling liquid (i.e., the cleaning solution) on and at the coating material 48. The excitation causes friction and thus turns the acoustic energy to heat. The heat causes the water molecules of the cleaning solution to move apart forming gas or steam which condenses on colder surrounding areas, thereby causing voids to develop. Adjacent molecules fill in the voids, violently sending shock waves through the coating material 48 and initiating a series of subsequent chain reactions and surface implosions. This causes the coating material 48 (e.g., polymer) to be instantly softened and "blasted" from the surface 14 of the print substrate 16. The softening characteristic of the solvent is so enhanced by cavitation that the cleaning of the surface 14 of the print substrate 16 is immediate and complete so as not to require additional mechanical cleaning.

In accordance with one embodiment of the present invention, the cleaning solution is an aqueous-based solvent-type cleaning solution that is specifically formulated to soften the coating material 48 on the surface 14 of the print substrate 16. As detailed above, this type of cleaning solution, when sprayed onto the coating material, also serves to focus the energy of the ultrasonic horn 40 onto the coating material 48 to initiate and sustain acoustic cavitation. In general, however, any suitable type of atomized aqueous spray, including plain water, may be used to couple and focus the energy of the ultrasonic horn 40 onto the coating material 48 on the surface 14. Of course, the choice of cleaning solution is dependent on many different factors, including, for example, the material characteristics of the coating material 48, the power of the ultrasonic transducer 42, etc.

During and after the cleaning process a vacuum is drawn within the vacuum port 62 of the vacuum cannula 46. The vacuum removes any excess cleaning solution and all of the debris resulting from the cleaning process from the surface 14 of the print substrate 16. This leaves the surface 14 clean and dry. The removed materials are subsequently transferred through the hose 64 to entrainment separators (not shown) for collection and disposal.

The ultrasonic acoustic cleaning apparatus 12 of the present may be used as a stand-alone device as shown in FIG. 1, or may be coupled to other components of the printing press 10. For example, the ultrasonic acoustic cleaning apparatus 12 may be coupled to the imaging system 28. As such, a separate drive system for the ultrasonic acoustic cleaning apparatus 12 is not required; displacement of the ultrasonic acoustic cleaning apparatus 12 is provided by the drive system D2 of the imaging system 28 (or vice-versa). This configuration may be useful, for example, when access to the plate cylinder 18 in the printing press 10 is limited. It should be apparent that the ultrasonic acoustic cleaning apparatus 12 could also be coupled to the spraying system 24. In this case, displacement of the ultrasonic acoustic cleaning apparatus 12 is provided by the drive system D1 of the spraying system 24 (or vice-versa).

Figure 4:
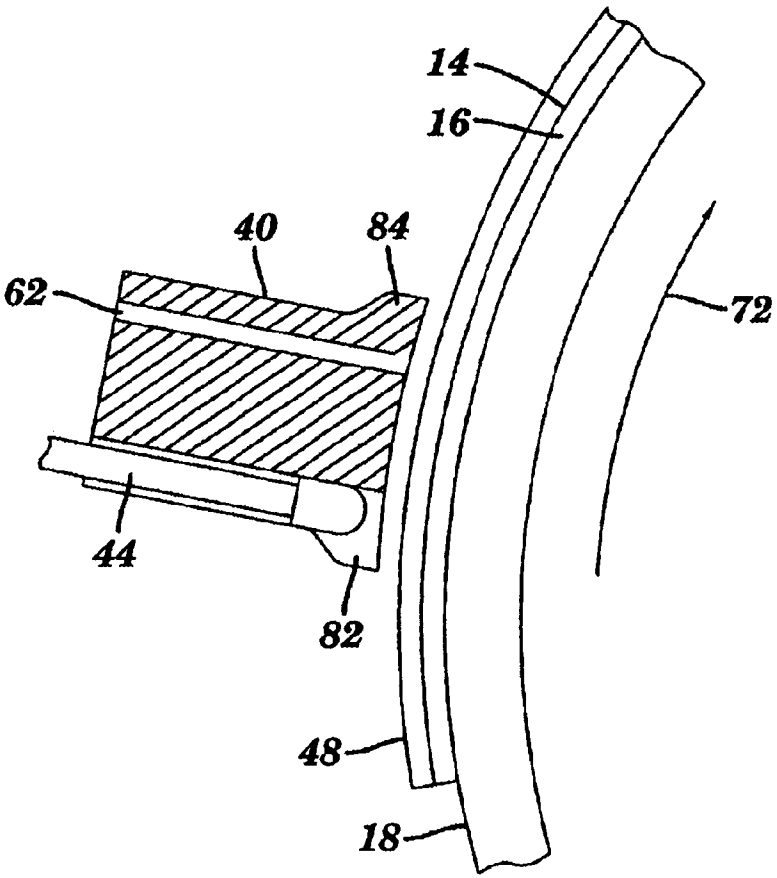
FIG. 4 illustrates an ultrasonic acoustic cleaning apparatus in accordance with another embodiment of the present invention.

Another embodiment of an ultrasonic acoustic cleaning apparatus 80 is illustrated in FIG. 4. In this embodiment, the vacuum port 62 and the spray nozzle 44 are incorporated within the body of the ultrasonic horn 40. This provides a more compact system. With the ultrasonic horn 40 excited, cleaning solution is introduced by the spray nozzle 44 at the leading end 82 of the ultrasonic horn 40 where cavitation begins. As the plate cylinder 18 continues to rotate, the coating material 48 is loosened and removed from the surface 14 of the print substrate 16 by the cavitation process. Any remaining cleaning solution and debris from the cleaning process is sucked from the surface 14 into the vacuum port 62 as the surface 14 passes under the trailing end 84 of the ultrasonic horn 40.

The foregoing description of the present invention has been presented for purposes of illustration and description. It is not intended to be exhaustive or to limit the invention to the precise form disclosed, and many modifications and variations are possible in light of the above teaching. For example, the ultrasonic acoustic cleaning apparatus of the present invention may be used to clean a coating material that has been applied directly to a surface of the plate cylinder. Such modifications and variations that may be apparent to a person skilled in the art are intended to be included within the scope of this Invention.

What is claimed is:

1. A method for cleaning a print substrate on a plate cylinder, comprising:

applying a cleaning solution onto a surface of the print substrate using an atomizing spray nozzle;

rotating the plate cylinder to displace the print substrate under an ultrasonic acoustic cleaning apparatus to dislodge a coating material from the surface of the print substrate;

removing the dislodged coating material and the cleaning solution from the print substrate using a vacuum system; and enclosing the atomizing spray nozzle, the ultrasonic acoustic cleaning apparatus, and a vacuum port of the vacuum system within a vacuum cannula.

2. The method of claim 1, further comprising:

displacing the vacuum cannula axially along the print substrate during rotation of the plate cylinder.

3. An apparatus for cleaning a print substrate on a rotating plate cylinder, comprising:

a system, which comprises an atomizing spray nozzle, for applying a cleaning solution onto a surface of the print substrate;

an ultrasonic acoustic cleaning apparatus for dislodging a coating material from the surface of the print substrate;

a vacuum system for removing the dislodged coating material and the cleaning solution from the print substrate; and a vacuum cannula for enclosing the atomizing spray nozzle, the ultrasonic acoustic cleaning apparatus, and a vacuum port of the vacuum system.

4. The apparatus of claim 3, further comprising:

a system for displacing the vacuum cannula axially along the print substrate during rotation of the plate cylinder.

5. An apparatus for cleaning a rotating print substrate, comprising:

a system for applying a cleaning solution to the rotating print substrate using an atomizing spray nozzle;

an ultrasonic acoustic cleaning apparatus, including an ultrasonic horn and an ultrasonic transducer for driving the horn, for dislodging a coating material from the print substrate using acoustic cavitation, wherein the atomized cleaning solution serves to focus the energy of the ultrasonic horn onto the coating material to produce the acoustic cavitation;

a vacuum system for removing the dislodged coating material and the cleaning solution from the print substrate; and a vacuum cannula for enclosing the atomizing spray nozzle, the ultrasonic acoustic cleaning apparatus, and a vacuum port of the vacuum system.

6. An apparatus for cleaning a rotating print substrate, comprising;

a system for applying a cleaning solution to the rotating print substrate using an atomizing spray nozzle;

an ultrasonic acoustic cleaning apparatus, including an ultrasonic horn and an ultrasonic transducer for driving the horn, for dislodging a coating material from the print substrate using acoustic cavitation, wherein the atomized cleaning solution serves to focus the energy of the ultrasonic horn onto the coating material to produce the acoustic cavitation;

a vacuum system for removing the dislodged coating material and the cleaning solution from the print substrate; and wherein the atomizing spray nozzle and a vacuum port of the vacuum system are incorporated within the ultrasonic horn.

* * * * *